US007600308B2

(12) United States Patent
Bussey, Jr. et al.

(10) Patent No.: US 7,600,308 B2
(45) Date of Patent: Oct. 13, 2009

(54) METHOD FOR MAKING A DRAINAGE ELEMENT

(76) Inventors: Harry Bussey, Jr., 960 Cape Marco Dr., Unit 1803, Marco Island, FL (US) 33937; Buddy Harry Bussey, III, 4 Windy Hill, Atlantic Highlands, NJ (US) 07716

( * ) Notice: Subject to any disclaimer, the term of this patent is extended or adjusted under 35 U.S.C. 154(b) by 754 days.

(21) Appl. No.: 11/106,108

(22) Filed: Apr. 14, 2005

(65) Prior Publication Data

US 2006/0075620 A1 Apr. 13, 2006

Related U.S. Application Data

(63) Continuation-in-part of application No. 10/960,615, filed on Oct. 7, 2004, now Pat. No. 7,178,224.

(51) Int. Cl.
*B23P 17/00* (2006.01)
*E02B 11/02* (2006.01)

(52) U.S. Cl. ..... 29/429; 29/819; 53/469; 405/45; 428/35.2; 428/36.5

(58) Field of Classification Search ..... 29/429, 29/819, 820, 234; 53/469, 473; 405/45; 428/35.2, 36.92, 36.5, 158, 159
See application file for complete search history.

(56) References Cited

U.S. PATENT DOCUMENTS

| | | | | |
|---|---|---|---|---|
| 4,166,875 | A * | 9/1979 | Bussey, Jr. | 428/159 |
| 4,169,179 | A * | 9/1979 | Bussey, Jr. | 428/159 |
| 4,215,166 | A * | 7/1980 | Bussey, Jr. | 428/159 |
| 4,514,453 | A * | 4/1985 | Bussey, Jr. | 428/159 |
| 5,712,015 | A * | 1/1998 | Guillem | 428/70 |

* cited by examiner

*Primary Examiner*—Jermie E Cozart
(74) *Attorney, Agent, or Firm*—Francis C. Hand; Carella, Byrne, Bain et al.

(57) ABSTRACT

Drainage elements are made by delivering loose fill elements under gravity from a container into a sleeve of netting that is tied at one end to a pipe, or other endless element, that is passing through the container. The sleeve of netting is supplied from an apertured cage extending below the container. In one embodiment a blower and chute arrangement is used to blow air downwardly into the drainage element being formed to increase the rate of flow of the loose fill elements into the sleeve of netting.

10 Claims, 9 Drawing Sheets

METHOD FOR MAKING A DRAINAGE ELEMENT

This application is a Continuation-In-Part of application Ser. No. 10/960,615, filed Oct. 7, 2004 now U.S. Pat. No. 7,178,224B2.

This invention relates to an apparatus for making a drainage element. More particularly, this invention relates to an apparatus and method for making a drainage element for use in a sewage field, water drainage field, roadside drainage ditches and the like. Still more particularly, this invention relates to a drainage element of improved construction.

As is known, drainage elements have been constructed of a perforated plastic pipe surrounded by loose aggregate, such as foam plastic elements, beads, and other light weight materials. Various techniques have been known for making such drainage elements in a manufacturing plant so that the individual drainage elements may then be shipped to a construction site for use. Examples of such techniques are described in U.S. Pat. Nos. 5,015,123; 5,154,543; 5,535,499; 5,657,527; and 6,173,483.

As described in U.S. Pat. No. 5,015,123, a coil of perforated plastic pipe may be uncoiled and passed through a horizontally disposed hollow tube located within a mandrel while loose fill aggregate in the form of foam plastic elements is deposited under gravity from a hopper on a right angle into the mandrel and between the flights of an auger located on the hollow tube. Thus, as the auger rotates, the loose fill aggregate is moved forwardly by the flights of the auger. In addition, a sleeve of mesh material is mounted about the end of the mandrel and initially tied to the pipe. During operation, as the auger rotates, the loose fill material is driven forward into the space between the sleeve of mesh material and the pipe. This causes the pipe and the sleeve of mesh material tied to the pipe to move forwardly away from the mandrel. This apparatus functions in the manner of an extruder to drive the loose fill material into the space between the mesh material and the pipe thereby causing the pipe to move forwardly.

However, one of the drawbacks of this type of apparatus is that the loose fill material is not uniformly dispensed about the circumference of the mandrel and thus of the finished product. As a result, once the drainage elements are placed in a field, there may be non-uniformity in the manner in which the drainage elements function. Further, should a need arise to stop the auger in order to tie the rear end of the sleeve of mesh material to the pipe, the loose fill material at the front end of the mandrel may spill out of the apparatus. Also, since the auger is typically mounted in a cantilevered manner within the mandrel, the auger deflects over its length and may come into contact with the inside of the mandrel thereby causing wear.

Another drawback for this type of apparatus is that the apparatus requires an expenditure of energy to drive the loose fill material horizontally into the sleeve of mesh material and to form a compact drainage element that can be readily handled in the field.

Accordingly, it is an object of this invention to provide an apparatus for making lightweight drainage elements of compact construction in an inexpensive manner.

It is an object of this invention of to provide a simple apparatus for making a composite drainage element of plastic pipe and surrounding lightweight aggregate.

It is another object of the invention to provide a simple technique for placing loose light weight aggregate about a perforated pipe for making a drainage element.

It is another object of the invention to reduce wear in an apparatus for making drainage elements.

It is another object of the invention to reduce the space required for an apparatus to make composite drainage elements.

It is another object of the invention to fabricate drainage elements of composite construction at a reduced cost.

It is another object of the invention to maintain a pipe centered within a drainage element during and after fabrication.

Briefly, the invention provides an apparatus for making composite drainage elements that is of simple construction and that can be operated in an efficient manner.

The apparatus includes a frame of skeletal construction, a container that is mounted on the frame and that has a chamber and at least one inlet for the supply of loose fill elements into the chamber and a chute that communicates with and extends from an underside of the chamber in order to convey loose fill elements out of the container under gravity.

In addition, the apparatus includes a sleeve that extends through the container and concentrically within the chute in order to define a passageway for a length of corrugated pipe or other elongated element. The sleeve also defines a space with the chute for the passage of loose fill elements from the container. A suitable drive means is also mounted on the frame for driving a corrugated pipe through the sleeve.

The container may be supplied with loose fill elements through one or more inlets to the chamber for example, on a manual basis, a batch basis and/or an automatic continuous basis. Generally, the container is supplied with sufficient loose fill elements to make a plurality of composite drainage elements. Similarly, the length of corrugated pipe supplied to the apparatus is of a length to form a plurality of composite drainage elements.

The apparatus also includes a gate that is located between the container and the chute and that is movable between an open position to allow loose fill elements to flow out of the chute and a closed position to block the flow of loose fill elements from the container into the chute. A suitable control means is also provided for selectively moving the gate between the open position and the closed position.

The chute is constructed so as to receive a cage that is removably mounted on the chute in suspended relation for supplying a sleeve of netting that is sufficient length to form a plurality of composite drainage elements. The cage extends downwardly beyond the lower end of the sleeve through which the corrugated pipe is delivered.

In one embodiment, the cage is provided with a cylindrical collar at one end for mounting on the chute in a telescoping manner, a plurality of circumferentially spaced ribs that extend from the collar for receiving the sleeve of netting thereon in bunched relation and a hoop secured to the ribs at an opposite end of the cage to secure the ribs together and to form a surface over which the netting can be pulled. In this embodiment, the hoop is constructed to have a greater outside diameter than the collar for radially expanding the sleeve of netting as the sleeve is pulled from the cage in a uniform manner.

In order to use the apparatus, a cage that has been loaded with a length of netting is passed concentrically about the sleeve extending below the chute and is secured to the lower end of the chute, for example, in a manually removable manner. In addition, a length of corrugated pipe is fed through the sleeve and into the cage to a point below the lower end of the cage. The container is also filled with loose fill elements. These three steps may be performed in any suitable order.

The forward end of the netting is then pulled from the cage over the hoop at the lower end of the cage and tied in a suitable manner to the exposed end of the corrugated pipe. Thereafter, the drive means for the corrugated pipe is started so that the pipe begins to move downwardly thereby pulling the netting over the hoop on the cage.

Next, the gate is opened between the container and chute to allow the loose fill elements to fall under gravity through the space between the sleeve and the chute and thence into the space between the sleeve and the cage and thence into the space between the moving pipe and the netting. The netting serves to retain the loose fill elements within the confines of the cage defined by the circumferentially spaced ribs.

During this time, the corrugated pipe is driven by the drive means at a suitable speed to allow the loose fill elements that are falling under gravity to fill the space between the netting and the corrugated pipe. In this respect, since the sleeve of netting is expanded radially while passing over the hoop at the lower end of the cage, the loose fill elements fill the space within the netting which is of greater radial extent than the interior diameter of the collar at the upper end of the chute. As the netting moves off the hoop, the netting begins to constrict radially inwardly to a smaller diameter thereby radially compacting the loose fill elements.

After a predetermined length of corrugated pipe has been driven through the apparatus, the gate is closed to block further delivery of loose fill elements. The corrugated pipe is driven further at the same speed to permit the loose fill elements below the gate to pass out of the lower end of the cage into the netting. At this time, the movement of the corrugated pipe is stopped and the netting is secured to the pipe to thereby complete a composite drainage element. The netting is also secured to the corrugated pipe to begin the start of another composite drainage element and the cycle of operation of the apparatus is repeated.

After a composite drainage element has been formed, a suitable cutting means may be used to cut the netting and corrugated pipe between individual composite drainage elements. Alternatively, a series of composite drainage elements may be formed without cutting of the corrugated pipe. For example, individual drainage elements in lengths, for example, of 8 feet to 20 feet may be made or a string of drainage elements may be made with an overall length of 100 feet or more.

The apparatus may also be provided with a blower that communicates with the chute for blowing a stream of air downwardly into the chute for directing loose fill elements through the chute and between the chute and sleeve. Such a blower may be used to insure that the loose fill elements are emptied from the chute and to prevent jamming of the loose fill elements in the container. Alternatively, a vibrator may be used to vibrate the chute and/or container and/or cage in order to insure that the loose fill elements are emptied from the chute and to prevent jamming of the loose fill elements in the container.

Since the pipe is delivered almost immediately into the loose fill elements and the netting upon emerging from the sleeve, the pipe is kept from migrating and is maintained in a centered position.

In still another embodiment, the cage of netting may be mounted directly under the container while the chute and blower are mounted below the cage. In this embodiment, the loose fill elements flow directly from the container into the cage the net is tied to the pipe as in the other embodiments and the loose fill elements fill the space between the pipe and the netting. As a drainage element is being formed below the cage, the drainage element passes through the chute. Thus, air that is blown through the chute from the blower serves to facilitate filling of the drainage element, for example by increasing the rate of filling and/or by compacting the loose fill elements within the netting.

The invention also provides a method of making drainage elements that comprises the steps of guiding an elongated element through a sleeve having a vertical component; securing an end of a sleeve of netting to the elongated element; dispensing loose fill elements circumferentially under gravity into a space between the netting and the sleeve; and thereafter securing the sleeve of netting to the elongated element to define a drainage element. The elongated element may be a tubular perforated pipe, a wire, a rope or any other suitable element.

Typically, the elongated element is guided along a vertical path; however, the elongated element may be guided on a path having an angle of 45° to the horizontal. During operation, the elongated element is continuously driven to permit securement of the netting to the elongated element on the fly or periodically stopped to allow securement. The sleeve of netting may be secured to the elongated element at spaced apart points to define a series of interconnected drainage elements or, after the sleeve of netting is attached, the elongated element is cut to form a single drainage element and a fresh drainage element started.

The invention also provides a method of providing a composite drainage element that has the loose fill elements in a highly compacted state thereby forming a stiffer drainage element that can be more readily handled in the field.

The method of making the composite element begins with obtaining a supply of expanded loose fill elements of polymeric material wherein the elements have been expended and before complete curing occurs, i.e. wherein the elements are characterized in still having a degree of latent foaming ability. Thereafter, the sleeve of netting is filled with a loose fill elements to form a structure using the apparatus as described above.

After one or more individual drainage elements have been made or a string of elements made, the compacted structures are exposed to an ambient environment at a temperature sufficient to cause the loose fill elements to cure and to further expand thereby imposing a radial expanding force on the netting. Such an ambient temperature should be at 50° F. and above. At lower temperatures, expansion will take place but over a longer period of time and with a less amount of expansion.

As a result of the further expansion, the loose fill elements become more tightly compacted within the netting and the resultant drainage element(s) becomes stiff.

The method may be used to make composite elements with or without a length of corrugated pipe therein. For example, a composite element may be formed simply of a mass of loose fill elements within a sleeve of netting. These elements may be made of any suitable length and diameter. Smaller sized elements may be used as rigid packing elements for packing, for example, electronic equipment. Such elements may be used in place of foamed-in place elements.

Longer and wider elements may be used in drainage for foundation walls and roadside trenches or the like.

These and other objects and advantages of the invention will become more apparent taken in conjunction with the accompanying drawings wherein.

Figure 9:
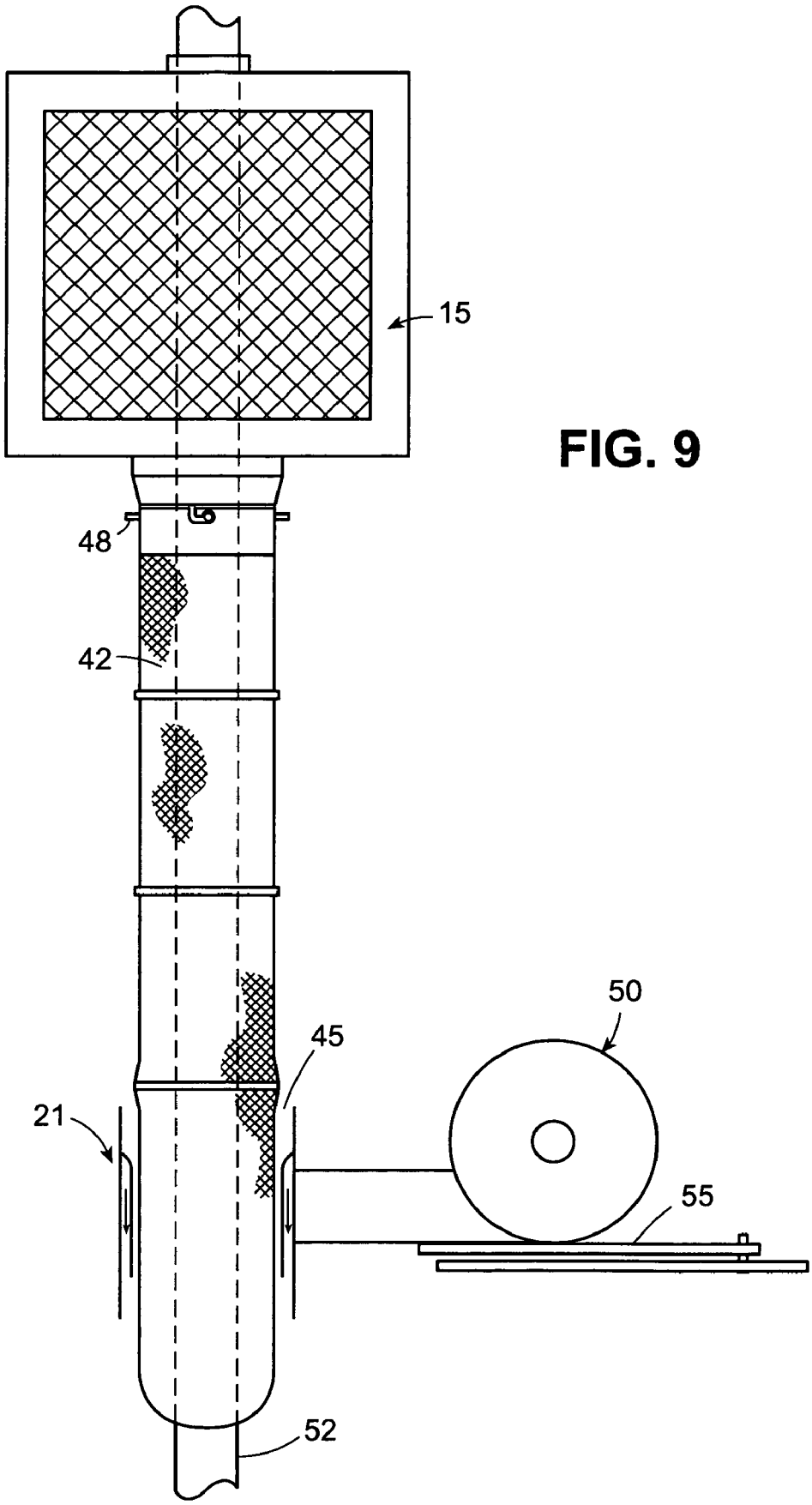

FIG. 9 schematically illustrates another embodiment of the apparatus of the invention.

Figure 1:
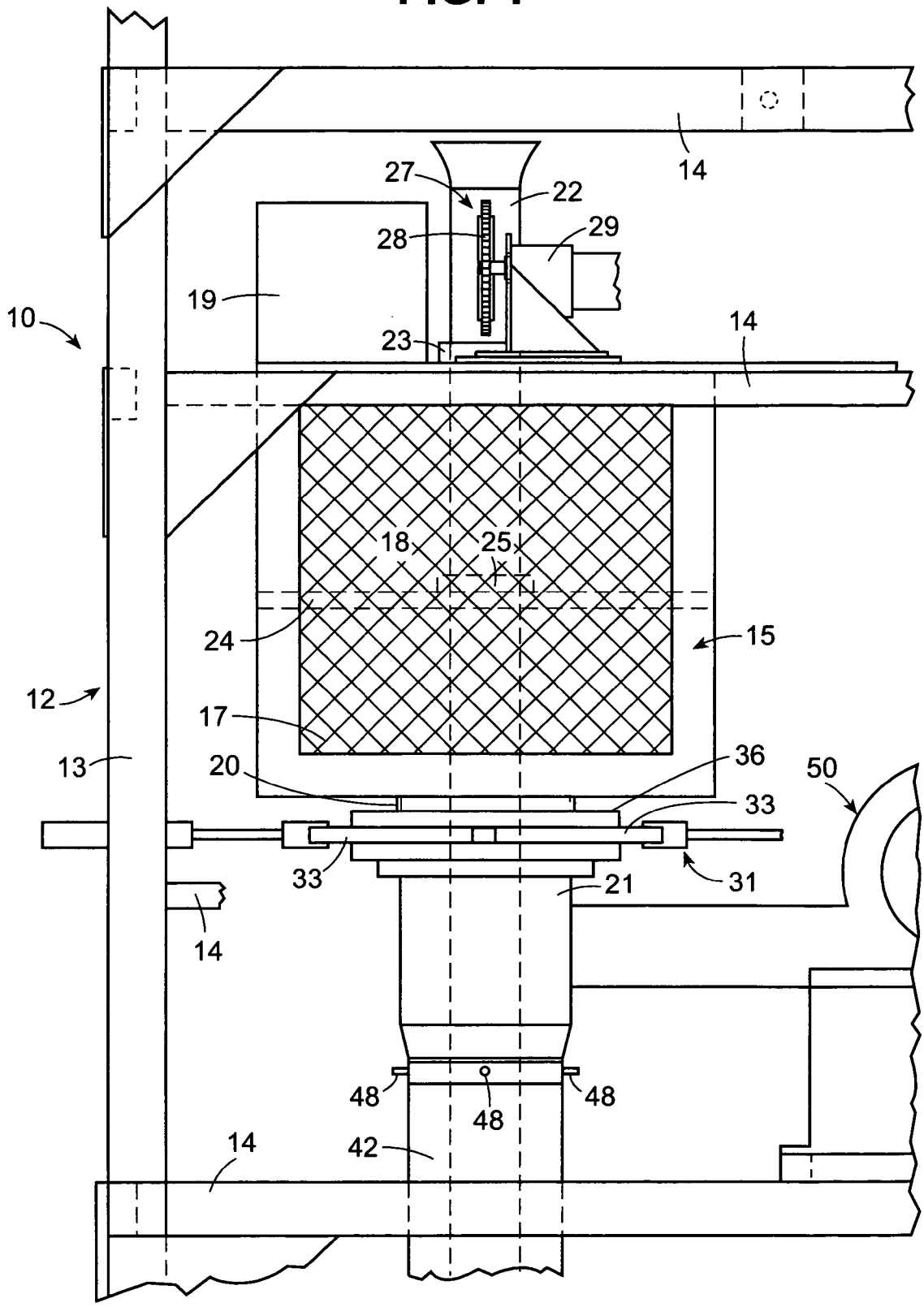
FIG. 1 illustrates a partial cross sectional view of an apparatus constructed in accordance with the invention.
Figure 2:
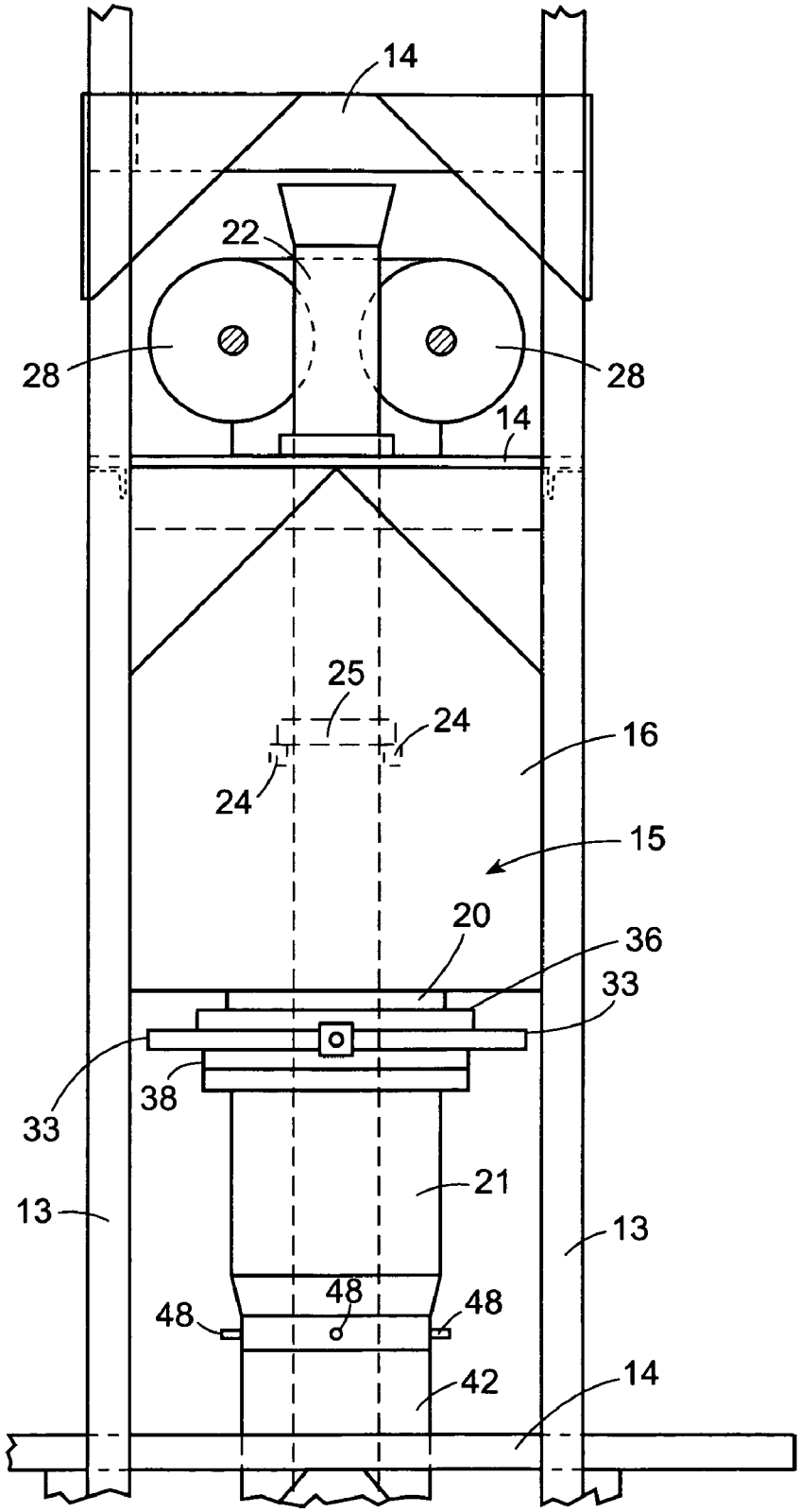
FIG. 2 illustrates a side view of the apparatus of FIG. 1.
Figure 4:
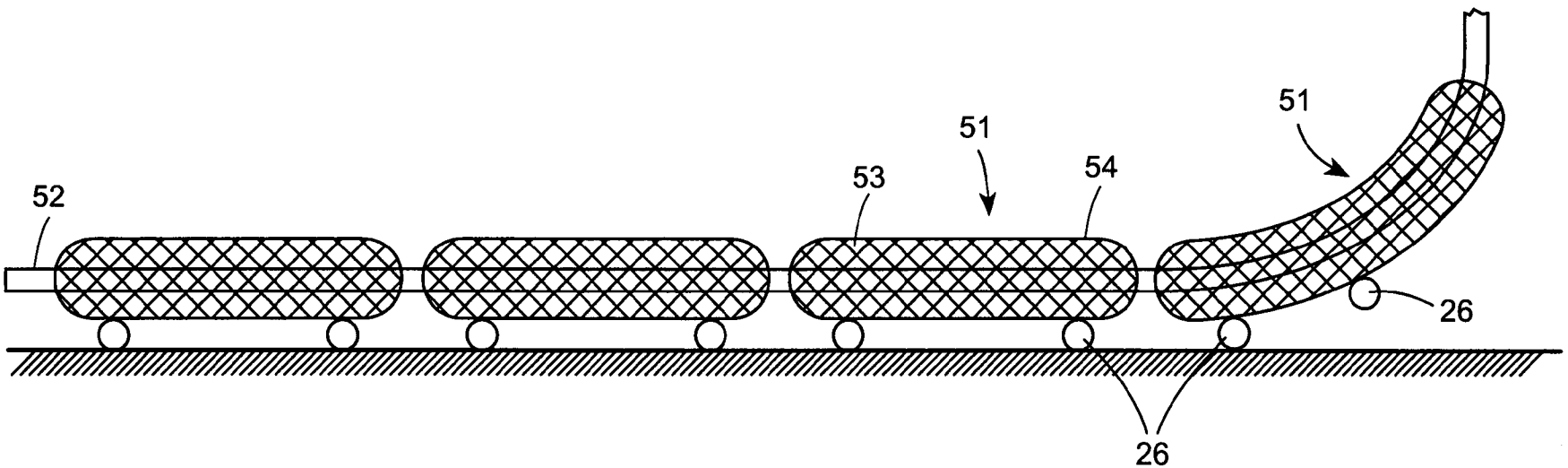
FIG. 4 illustrates a view of a series of composite drainage elements formed in a unitary manner in accordance with the invention.

Referring to FIGS. 1 and 2, the apparatus for making composite drainage elements such as those illustrated in FIG. 4 includes an upright frame 12 of skeletal construction, for example, having four vertical posts 13 and a plurality of beams 14 interconnecting the posts 13 at different levels. The frame 12 occupies a limited amount of floor space, for example of less than 12 square feet.

The apparatus also has a container 15 that is mounted on a second level of the frame 12. As illustrated, the container 15 is mounted in suspended fashion from the beams 14 at the second level and between the posts 13 (see FIG. 2). The container 15 is of box-like shape having two solid side walls 16 (see FIG. 2) and a pair of opposite walls 17 of mesh construction.

The container 15 defines a chamber 18 that has at least one inlet 19 through which a supply of loose fill elements may be delivered into the chamber 18. For example, a supply of loose fill elements may be fed manually through the inlet 19 into the chamber 18. Alternatively, a duct, (not shown) may be provided to deliver loose fill elements or other suitable aggregate into the chamber 18 on a continuous or batch basis.

The container 15 also has an outlet 20 on the underside for an outflow of loose fill elements or other aggregate delivered to the container 15 and a chute 21, for example, of cylindrical shape that is secured to the underside of the container as described below in order to communicate with the chamber 18 via the outlet 20. The chute 21 is sized to convey loose fill elements from the chamber 18 under gravity.

The apparatus 10 also has a sleeve 22 that extends through the container 15 and through the chute 21 to a point below the chute 21. As illustrated, the sleeve 22 has an upper end that is radially outwardly flared to form an entrance for a corrugated pipe (not shown) or other elongated element and is secured by a bracket 23 to the top of the container 15. By way of example, the corrugated pipe may be one as supplied by Hancor, Inc. of Findlay, Ohio with provision every ten feet for a coupling to be formed when the pipe is separated within that area.

The interior of the container 15 has a pair of guide rods 24 secured thereacross on which a collar 25 is secured to guide the sleeve 22 through the container 15. As illustrated, the sleeve 22 is disposed concentrically within the chute 21 in order to define a space therewith for receiving loose fill elements from the container 15.

Figure 5:
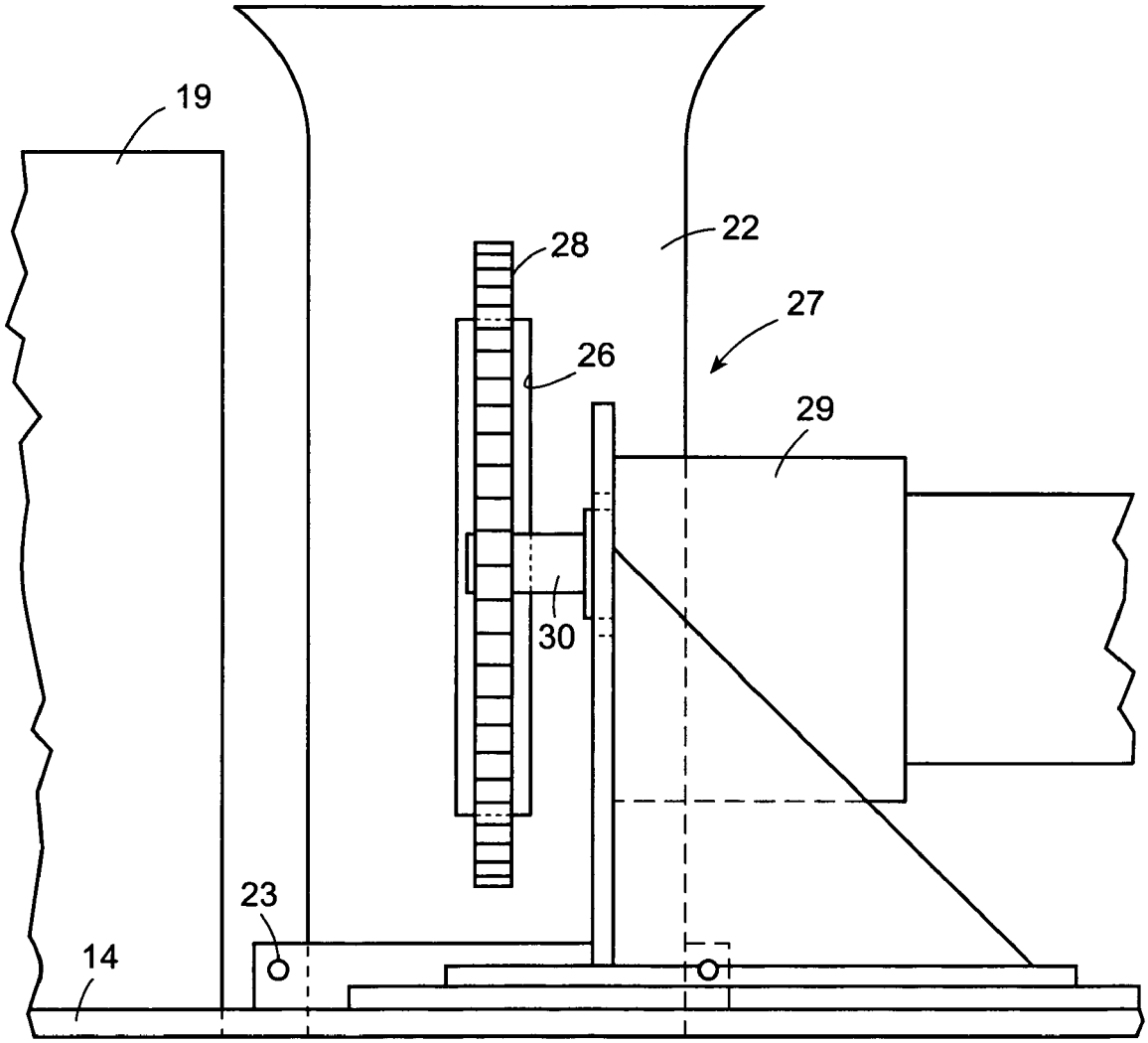
FIG. 5 illustrates a partial enlarged view of a sleeve and drive means for guiding and driving a corrugated pipe through the apparatus in accordance with the invention.
Figure 6:
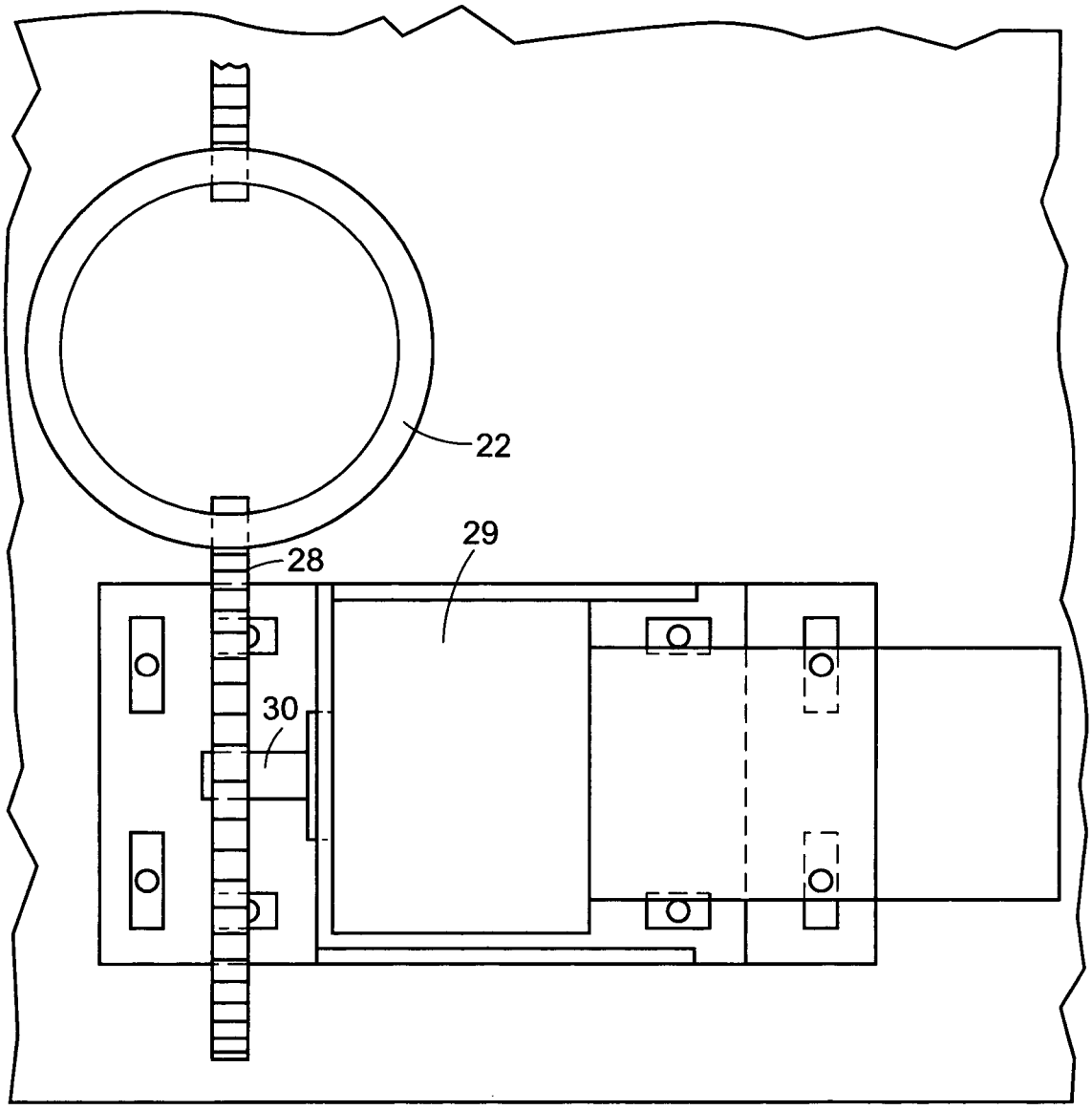
FIG. 6 illustrates a top view of the sleeve and drive means shown in FIG. 5.

Referring to FIGS. 5 and 6, the upper end of the sleeve 22 is provided with a pair of elongated vertical slots 26 on opposite sides and a drive means 27 is mounted on the frame 12 at an upper end for driving a length of corrugated pipe (not shown) through the sleeve 23. The drive means 27 includes a pair of rotatable toothed rollers 28 (only one of which is shown) that engage opposite sides of the corrugations of the pipe in order to drive the pipe downwardly through the sleeve 22. Each roller 28 is driven by a motor 29 and shaft 30. The toothed rollers 28 may also be staggered vertically relative to each other to insure that at least one roller 28 engages one or more corrugations in a corrugated pipe at all times.

As illustrated in FIG. 6, each roller 28 projects through the slot 26 of the sleeve 22 in order to engage the corrugations of a corrugated pipe (not shown) to thereby drive the corrugated pipe downwardly through the sleeve 22 and the apparatus 10. Where the pipe is of smooth-walled construction, the toothed rollers 28 may be replaced by nip rollers.

Referring to FIG. 1, the apparatus includes a gate 31 that is located between the container 15 and the chute 21. This gate 31 is movable between an open position (not shown) and a closed position as illustrated for selectively opening and closing a passage between the container 15 and the chute 21 for the passage of loose fill elements from the container 15 into the chute 21.

Figure 7:
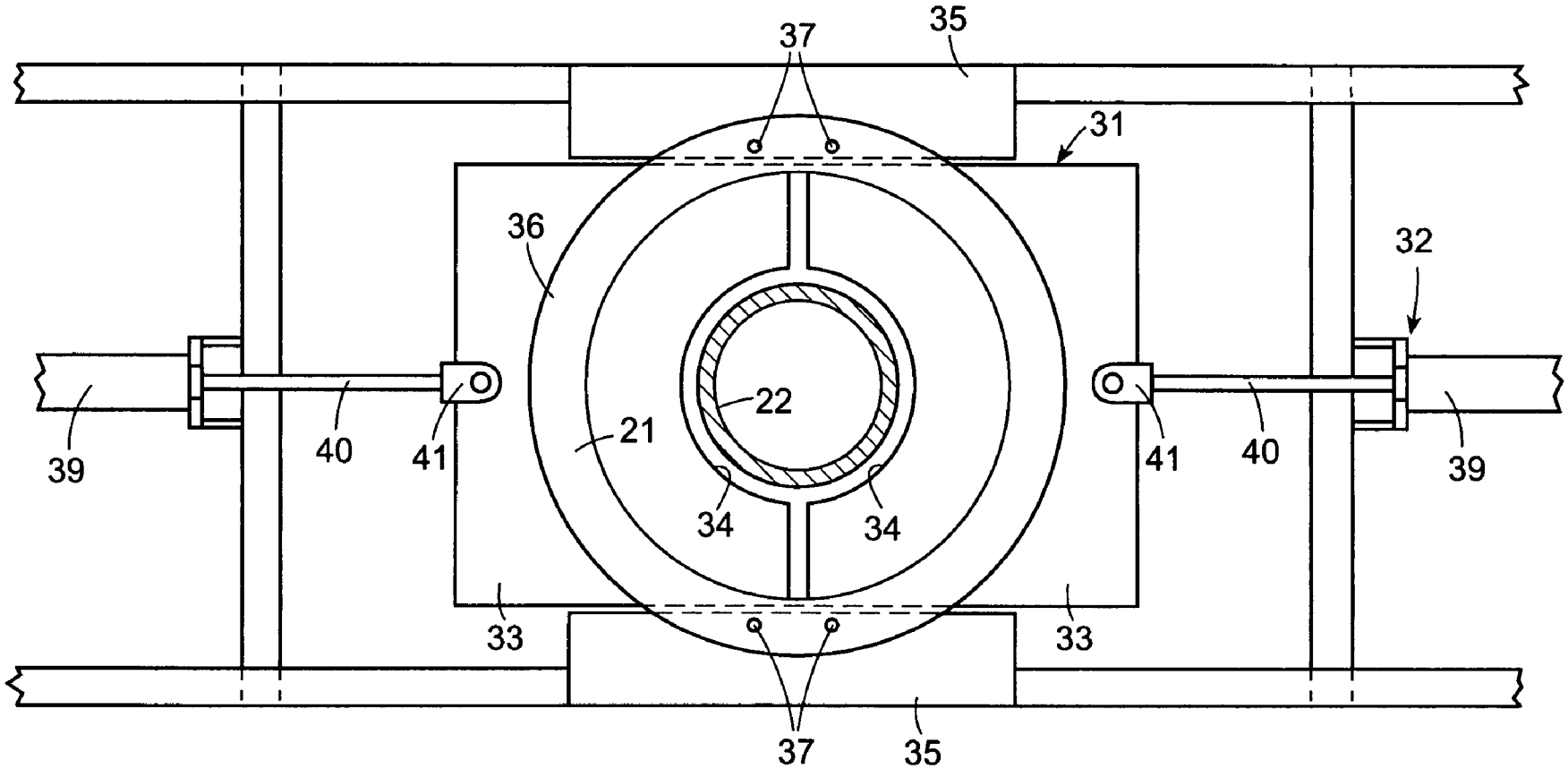
FIG. 7 illustrates a top view of a gate to control the flow of loose fill elements out of the container in accordance with the invention.
Figure 8:
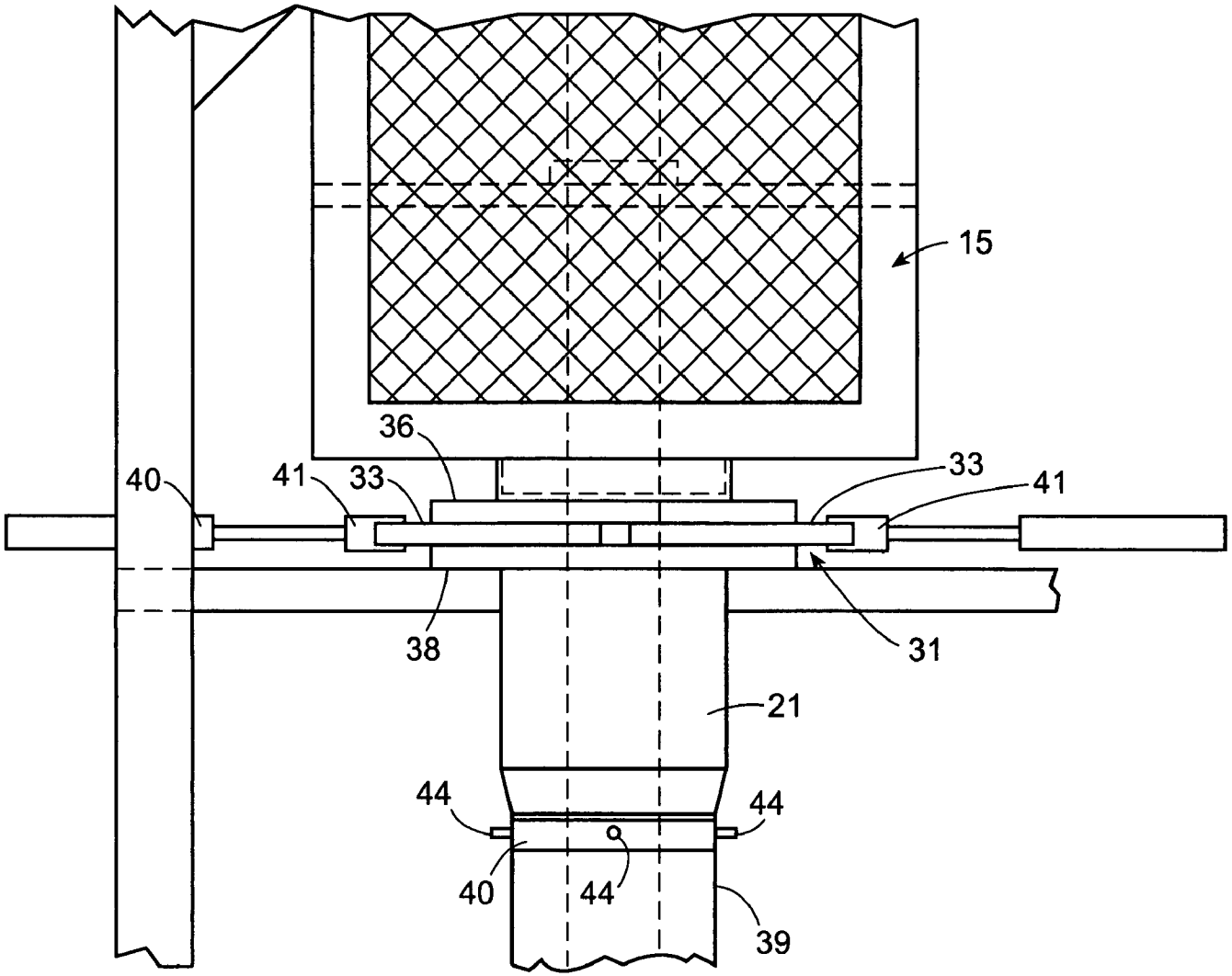
FIG. 8 illustrates a side view of the gate of FIG. 7.

Referring to FIGS. 7 and 8, a control means 32 is provided for moving the gate 31 between the open position and the closed position. When the gate 31 is in the closed position, the flow of loose fill elements into the chute 21 is blocked for purposes as described below.

The gate 31 is formed by a pair of plates 33 each of which is of generally rectangular shape with a semi-circular recess 34 in one edge facing the other plate 33 (see FIG. 7). When in the closed position, as illustrated, the plates 33 are spaced from the sleeve 22 by a small distance, e.g. one-half inch to thereby prevent a flow of loose fill elements from the outlet 20 of the container 15 beyond the plates 33 and into the chute 21 as well as to avoid crushing or cutting the loose fill elements.

Referring to FIG. 7, a pair of plates 35 are secured to the cross beams 14 of the frame 12 to serve as lateral guides for the movable plates 33. In addition, a ring 36 is mounted on the plates 35 and secured thereto as by bolts 37. This ring 36 is concentric to the sleeve 22.

The bolts 37 pass through the ring 36 and the respective plates 35 as well as through a mounting flange 38 on the chute 21 and cooperate with nuts (not shown) to secure the chute 21 to the ring 36 in a depending manner. Thus, the ring 36 forms a guide for the movable plates 33 from above and the mounting flange 38 forms a guide for the movable plates 33 from below.

The control means 32 includes a pair of air cylinders 39, one for each plate 33 (only one of which is shown in FIG. 7). Each air cylinder 39 is mounted on the frame 12 and has a reciprocally mounted piston 40 that is connected via a clevis 41 to one of the plates 33. Thus, when the piston 40 is expelled from a respective cylinder 39, the plate 33 secured thereto is moved into the closed position as shown in FIGS. 7 and 8. When the pistons 40 is retracted, the plates 33 are moved out of the plane of the opening between the outlet 20 of the container 15 and the chute 21.

The inlet 19 for delivering loose fill elements into the container 15 may be disposed on the upper end of the container or in a side wall of the container 15.

As shown in FIG. 1, a cage 42 that is removably mounted on the chute 21 in suspended relation.

Figure 3:
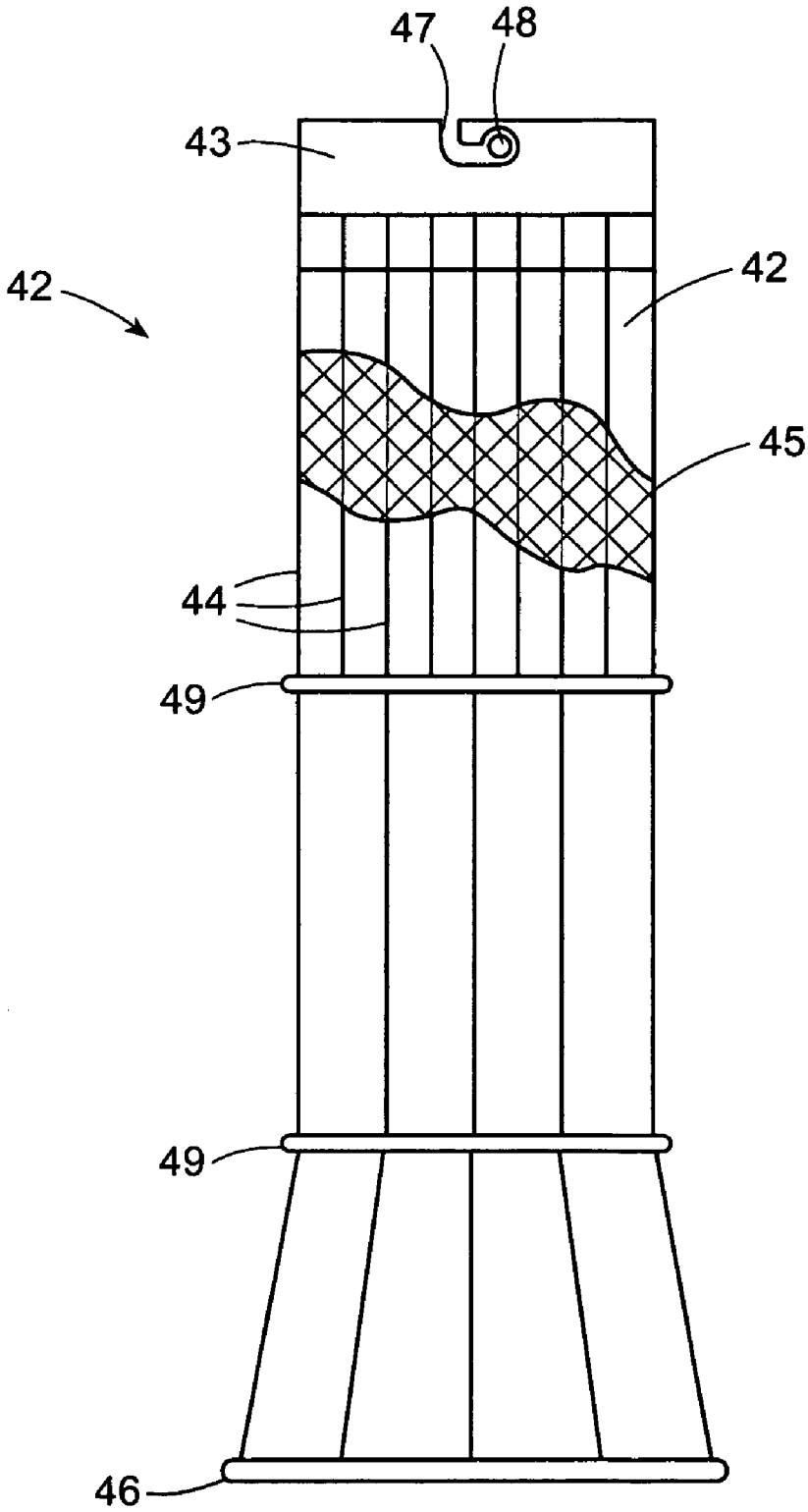
FIG. 3 illustrates a view of a cage constructed in accordance with the invention.

Referring to FIG. 3, the cage 42 includes a means, such as a cylindrical collar, 43 at one end for mounting on the chute 21, a plurality of circumferentially spaced ribs 44 that extend from the inside of the collar 43 for receiving a sleeve of netting 45 thereon in bunched relation and a hoop 46 secured to the ribs 44 at an opposite end of the cage 42 from the collar 43.

The collar 43 is made of aluminum or other suitable material and is provided with L-shaped slots 47 to facilitate mounting of the cage 42 on pins 48 located at the lower end of the chute 21 (see FIG. 1). The collar 43 has a limited length, for example, of from 4 to 6 inches and an outside diameter of 11⅜ inches Alternatively, the means for mounting the cage 42 may be in the form of a mounting ring, a plurality of clips for attaching to clips or the like on the chute 21, or any other suitable mounting means.

The ribs 44 are in the form of ¼ inch metal rods that are welded to the inside of the collar 43 and have staggered lengths so that the number of ribs decrease by one third for each one-third length of the cage 42. For example, there are 24 ribs secured to the collar 43. The ribs 44 define an inner circle having a diameter slightly less than the inside diameter of the collar 43.

In addition, the lower ends of the ribs 44 that extend to the hoop 46 are tapered outwardly a distance ½ inch greater than the inner circle defined by the upper ends of the ribs.

The hoop 46 is a ½ inch rod that is secured to the ribs 44 on the outside of the ribs 44 and has a greater outside diameter than the outside diameter of the collar 43 and a greater outside diameter by 1½ inches than the inner circle defined by the upper ends of the ribs 44 for radially expanding the sleeve of netting 45 that is delivered thereover.

Cross rings 49 of ¼ inch diameter are secured to the outside of the ribs 44 at the one-third points of the length of the cage 42 to hold the ribs 44 and to cause the netting 45 to payout evenly.

Alternatively, the length of the collar 43 and the ribs 44 may be of any other suitable length.

The sleeve of netting 45 has a relaxed diameter of 9 inches and typically a length of from 100 to 1000 feet. The length is sufficient for forming a plurality of composite drainage elements.

When the netting 45 is pulled over the hoop 46, the outside diameter of the netting 45 radially enlarges so that the netting 45 is thus stretched radially outwardly.

Referring to FIG. 1, the apparatus may also include a blower 50 that is mounted on the beams 14 of the frame 12. This blower 50 communicates with the interior of the chute 21 for blowing a stream of air downwardly into the chute 21 in order to direct loose fill elements from the chute 21 and between the chute 21 and sleeve 22. The flow of air also creates a Venturi effect so as to draw loose fill elements from the chamber 18 of the container 15 downwardly into the chute 21. The blower 50 is an off-the-shelf item, namely a 5 horsepower blower and venturi available from Quick Draft, Inc. of Cleveland, Ohio.

In order to begin operation of the apparatus, a cage 42 filled with a sleeve of netting 45 is secured to the lower end of the chute 21. Thereafter, a length of corrugated pipe is fed into the upper end of the sleeve 22 and engaged between the rollers 28 of the drive means. About the same time, a charge of loose fill elements is delivered through the inlet 19 into the chamber 18 of the container 15.

The corrugated pipe is then driven by the rollers 28 downwardly to pass out of the chute and beyond the lower end of the cage 42 for a distance of a few inches. The rollers 28 are then stopped.

At this time, the netting 45 is pulled manually over the lower end of the cage 42 and secured in a suitable manner to the corrugated pipe. At this time, the central control (not shown) of the apparatus is actuated so that the rollers 28 are re-started to drive the corrugated pipe through the container 15 and the control means 32 actuated to move the plates 33 of the gate 31 to an open position. Thus, loose fill elements are allowed to fall under gravity through the chute 21 and into the interior of the cage 42.

As the corrugated pipe moves beyond the lower end of the cage 42, the loose fill elements fall under gravity to fill the space between the netting 45 and the corrugated pipe. During this time, since the netting is expanded radially upon passing over the hoop 46 at the lower end of the cage 42, the loose fill elements initially occupy a greater lateral space than the outer diameter of the collar 43 of the cage 42. As the netting 45 begins to contract radially inwardly, the loose fill elements are compacted radially by the netting. This provides for a compact construction of the drainage element being fabricated.

When a predetermined length of corrugated pipe has been delivered by the rollers 28, the control means 32 closes the gate 31 so that no further loose fill elements are delivered from the container 15 into the chute 21. After a further length of corrugated pipe has been delivered, the rollers 28 are stopped to interrupt the motion of the corrugated pipe. The additional length of pipe that is delivered is sufficient to allow the loose fill elements within the cage 42 to completely pass through the chute 21 and cage 42 into the space between the netting 45 and the corrugated pipe. The netting may then be secured manually about the corrugated pipe in a suitable manner to form the first composite drainage element. A following section of the netting is also secured to the corrugated pipe to begin the formation of the next composite drainage element.

Thereafter, the cycle of operation is repeated so that a series of drainage elements may be formed.

Referring to FIG. 4, a composite drainage element 51 formed by the apparatus has a corrugated pipe 52 centered within a mass of loose fill elements (aggregate) 53 and held in place by a tube of netting 54 secured at opposite ends to the pipe 52. As illustrated, a series of drainage elements 51 may be formed as a unitary structure without being severed into individual drainage elements. In this embodiment, the corrugated pipe 52 is made with a provision to form a coupling at incremental points, for example every 10 feet. For example, the corrugated pipe 52 has a plurality of spaced apart coupling forming areas therein, each area being severable into a first open end and a second end having at least one integrally formed protuberance thereon for fitting into open end in coupled relation. In addition, a mass of expanded elements of polymeric material is disposed circumferentially about the pipe 52 between the spaced apart areas and a plurality of netting sleeves are secured at the respective ends to the pipe between each pair of spaced apart areas to contain the loose fill elements. The unitary structure may be handled as such or may be cut in the designated areas into individual drainage elements.

After cutting, the rear end of the pipe of one drainage element has an open corrugated end and the forward end of the pipe in the next drainage element has a smooth male end with a plurality of circumferentially spaced protuberances, each with a sloped forward wall. The male end of the next pipe can thus be fitted into the open corrugated end of the pipe in front in coupled manner. As is known, this type of coupling may be easily made in the field.

It is to be noted that the blower 50 need not be operated in order to deliver loose fill elements into the netting 45 but may be operated to speed up the operation. The blower 50 may also be eliminated from the apparatus 10 in which case the cage 42 would be secured directly to the outlet 20 of the container 15 via pins (not shown) on the outlet 20.

Referring to FIG. 9, wherein like reference characters indicate like parts as above, in another embodiment, the chute 21 and blower 50 may be mounted below the cage 42 to allow the drainage element being formed to pass through the chute 21 and the blower 50 used to pass a flow of air through the chute 21 in a manner as described above to blow air downwardly through the drainage element being formed. The effect of the downward flow of air is twofold. Namely, the downward flow of air directs the aggregate within the netting 45 and below the plane at which the air is introduced downwardly thereby compacting the aggregate within the netting 45. The downward flow of air also creates a suction force on the aggregate above the plane at which the air is introduced to draw the aggregate downwardly thereby compacting the aggregate within the netting.

In this embodiment, the blower 50 is interconnected with the chute 21 and a means 55 is provided for moving the blower 50 to position the chute 21 in a first position under the cage 42 and a second position laterally spaced from the cage 42. For example, this means 55 includes a swivel on which the blower 50 is mounted so as to pivot the chute 21 laterally away from under the cage 42 in order to permit replacement of an emptied cage 42 with a fresh cage with a supply of netting.

The apparatus has been described wherein the sleeve 22 and cage 42 are located on a vertical axis. However, it is also within the scope of the invention to have the chute 21 and cage 42 located in angular relation to the outlet 20 of the container 15. For example, the cage 42 may be located on an angle 45 degrees from the vertical in order to reduce the overall height of the apparatus.

The apparatus may also be adapted for use in the field to lay pipe on a continuous basis. For example, the apparatus may be mounted on a movable frame for pivoting into an inclined position for delivering drainage elements on a continuous basis into an elongated ditch. In this case, there would be no need to separate the drainage elements into individual elements.

The apparatus may also be used to make a composite element with or without a corrugated pipe 52 or other endless element, such as an unperforated smooth pipe, a rope, a wire and the like, therein.

In order to fabricate a composite element of stiff construction, a supply of expanded loose fill elements of polymeric material is obtained shortly after expansion and before complete curing so that the loose fill elements are characterized in having a degree of latent foaming ability. In this respect, it is known that when foamable polymeric material is extruded to form loose fill elements, the material foams to a first stage. Thereafter, the material can be further heated and foamed to a second stage since the material has a residual amount of blowing agent therein that has not been fully expanded.

In some cases, in order to permit the residual blowing agent to fully expand and bleed from the material, the material can be cured over a period of time in a storage environment.

In accordance with the invention, the residual capacity of the loose fill elements to expand is utilized to form composite elements of stiff construction. In this respect, after the loose fill elements have been expanded and still have a degree of latent foaming ability, the elements are delivered to the apparatus 10 and filled into a sleeve of netting 45 to form a composite structure 51 as above. The compacted structures 51 are then exposed to an ambient environment of a temperature sufficient to cause the loose fill elements 53 to further expand and to thereby impose a radial expanding force on the netting 54. In this way, the loose fill elements 53 become tightly compacted and the resulting drainage element 51 becomes stiff without mechanical or pneumatic compaction.

In one embodiment, the loose fill material is delivered in a latent foaming state to a first expander and expanded in a conventional manner, for example under heat and is then delivered to an accumulator where the material is cured. Thereafter, the accumulated material is delivered to a second expander and expanded in a conventional manner and deposited into an accumulator. However, rather than storing the accumulated material for a conventional 24 hour period at ambient temperature to obtain a full curing of the material, the material is delivered in a lesser time, for example almost immediately or after two or three hours, into the container 15 of the apparatus for making the drainage elements, i.e. the expanded material is accumulated for a period of time of about 2 to 3 hours at ambient temperature. In this way, the material still has a residual amount of expandability that can be exploited after a drainage element has been made.

In accordance with the invention, the composite elements 51 need not be fabricated with a corrugated pipe or other endless element 52.

The invention thus provides an apparatus that is able to form one or more composite drainage elements in an efficient manner. In this respect, since the loose fill elements are delivered under gravity, there is no need for any energy to move the loose fill elements from the container 15 into the netting 45 as would be the case if the loose fill elements had to be moved horizontally. Further, by moving the corrugated pipe vertically, the rollers 28 need not overcome the force of gravity. Again, a reduced amount of energy is required for moving the corrugated pipe vertically downward.

The invention thus provides an apparatus that can be operated at low cost and in an efficient manner. As a result, the cost of manufacture of a composite drainage element can be held to a minimum.

Using a gravity feed in the apparatus and method of the invention is an important factor for reliability, simplicity and saving energy not to mention much fewer moving parts and, therefore, less maintenance. Further, the use of a gravity feed allows the apparatus to place a layer of loose fill material of any thickness about a pipe of any suitable diameter. For example, the pipe may have a diameter of up to 24 inches, 36 inches or more while the thickness of the loose fill aggregate about the pipe may be up to 10 inches, 20 inches or more. That is to say, problems that may be encountered in making large diameter drainage elements in accordance with previously known techniques are not present when using the present invention.

Further, the use of a cage as described above, in contrast to the use of a hollow tube or mandrel as a carrier for the netting, reduces the friction between the netting and the cage particularly at the lower end of the cage where there is a reduced number of ribs.

What is claimed is:

1. A method of making a drainage element comprising the steps of generating a supply of expanded loose fill elements of polymeric material characterized in having a degree of latent foaming ability therein capable of curing and further expanding;

filling a sleeve with said loose fill elements to form a compacted structure; and thereafter exposing the compacted structure to an ambient environment of a temperature sufficient to cause said loose fill elements to cure and further expand, and impose a radial expanding force on the sleeve and a longitudinally expanding force on the sleeve whereby the loose fill elements become tightly compacted and the resultant drainage element becomes stiff.

2. A method as set forth in claim 1 further comprising the step of positioning a length of pipe within the sleeve and loose fill elements with respective ends of the pipe extending from respective ends of the sleeve.

3. A method as set forth in claim 1 further comprising the step of positioning a length of perforated pipe within the sleeve and loose fill elements with respective ends of the pipe extending from respective ends of the sleeve to form a drainage element.

4. A method as set forth in claim 1 wherein said step of generating a supply of said material includes expanding a supply of latent foaming loose fill material to at least a first stage of expansion and accumulating the expanded material for a period of time less than a time required for fully curing the material prior to said step of filling the sleeve.

5. A method as set forth in claim 4 wherein the expanded material is accumulated for a period of time of about 2 to 3 hours at ambient temperature.

6. A method of making drainage elements comprising the steps of guiding an elongated element through a first sleeve having a vertical component;

securing an end of a sleeve of netting to the elongated element at a first point below said first sleeve;

dispensing loose fill elements circumferentially into a space between the netting and the first sleeve; and thereafter securing the sleeve of netting to the elongated element at a second spaced apart point from said first point to retain the loose fill elements therebetween to define a drainage element.

7. A method as set forth in claim 6 wherein the sleeve of netting is secured to the elongated element at spaced apart points to define a series of interconnected drainage elements.

8. A method as set forth in claim 7 further comprising the step of cutting the elongated element at each of said points to form separate drainage elements.

9. A method as set forth in claim 6 wherein the elongated element is guided in an intermittent manner along a vertical path and is periodically stopped to permit securement of the netting to the elongated element.

10. A method as set forth in claim 9 wherein the elongated element is a tubular perforated pipe.

* * * * *